US007101233B2

(12) United States Patent
Maeda

(10) Patent No.: US 7,101,233 B2
(45) Date of Patent: Sep. 5, 2006

(54) FEMALE TERMINAL FITTING

(75) Inventor: Taisaku Maeda, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 10/981,304

(22) Filed: Nov. 4, 2004

(65) Prior Publication Data

US 2005/0101198 A1 May 12, 2005

(30) Foreign Application Priority Data

Nov. 7, 2003 (JP) ..... 2003-378424

(51) Int. Cl.
*H01R 11/22* (2006.01)
*H01R 13/11* (2006.01)

(52) U.S. Cl. ..... 439/852; 439/853

(58) Field of Classification Search ..... 439/852, 439/851, 853, 854, 595
See application file for complete search history.

(56) References Cited

U.S. PATENT DOCUMENTS 5,947,777 A * 9/1999 Chaillot et al. ..... 439/852
5,951,339 A * 9/1999 Chaillot et al. ..... 439/852
5,980,336 A * 11/1999 Hall et al. ..... 439/843
6,024,612 A * 2/2000 Myer et al. ..... 439/852
2003/0216085 A1* 11/2003 Maeda ..... 439/852
2003/0220015 A1* 11/2003 Ishiyama ..... 439/595
2004/0180576 A1* 9/2004 Hasebe ..... 439/595

FOREIGN PATENT DOCUMENTS

JP 2000-133355 5/2000

* cited by examiner

*Primary Examiner*—Tulsidas C. Patel
*Assistant Examiner*—Vladimir Imas
(74) *Attorney, Agent, or Firm*—Gerald E. Hespos; Anthony J. Casella

(57) ABSTRACT

A female terminal fitting (10) has a box-shaped main portion (11) with an open front end. A resilient contact piece (17) is formed in the main portion (11) for resiliently contacting a mating male tab (30). A protection wall (22) extends continuously from a bottom wall (11C) before a resilient contact piece (17) while leaving a clearance for entry of the male tab (30). Catches (23) are provided at the opposite side edges of the protection wall (22) and engage with catchable portions (24) at the side edges of the front end of the main portion (11) for resisting opening forces on the main portion (11).

7 Claims, 9 Drawing Sheets

FEMALE TERMINAL FITTING

BACKGROUND OF THE INVENTION

1. Field of the Invention

The invention relates to a female terminal fitting with a resilient contact piece.

2. Description of the Related Art

Japanese Unexamined Patent Publication No. 2000-133355 and FIGS. 8 and 9 relate to a female terminal fitting. With reference to FIGS. 8 and 9, the female terminal fitting is formed by bending a metallic plate that has been stamped into a specified development. The female terminal fitting has a rectangular tube 1 with a bottom wall 2. A mating male tab 3 can be inserted into the main portion 1 and engages a resilient contact 4 that extends obliquely forward a base portion 5 at the rear end of the bottom wall 2. A fold 4A is folded from an intermediate portion of the resilient contact 4 and is turned toward the bottom wall 2. A leg 4B extends continuously in a returning direction from the fold 4A and is held in contact with the bottom wall 2. A protuberance 4E is provided near the fold 4A and can be brought into contact with the male tab 3. A protection wall 6 stands up to cover the fold 4A of the resilient contact piece 4 at the front surface of the main portion 1, and is continuous with the front end of the bottom wall 2. The protection wall 6 closes an opening at the front end of the main body 1 while leaving a clearance for receiving the male tab 3.

The male tab 3 is inserted into the main portion 1 of the female terminal fitting and contacts the protuberance 4E of the resilient contact 4. As a result, the resilient contact 4 is pressed down and resiliently deforms towards the bottom wall 2. However, an excessive force is exerted on the bottom wall 2, and offsets a balance of force trying to keep the main body 1 in box shape. As a result, there is a possibility of opening deformations of the main portion 1 from bending edges 7.

The bottom wall 2 of the main portion 1 could be folded into a double-wall structure that would be stronger and less likely to deform from the box shape. However, extra metallic plate material would have to be provided to make the bottom wall 2 into a double-wall structure. This double wall design would lead to a higher production cost, and hence is undesirable.

The present invention was developed in view of the above problem and an object thereof is to prevent opening deformations of a main portion.

SUMMARY OF THE INVENTION

The invention is a female terminal fitting with a main portion formed into a box shape that extends substantially along forward and backward directions. A resilient contact is formed at a bottom wall of the main portion and is resiliently deformable toward the bottom wall in response to contact with a mating male tab. A protection wall stands up before the resilient contact piece and is substantially continuous with the bottom wall. The protection wall partly closes an opening at the front end of the main portion while leaving a clearance for permitting entry of the male tab. At least one catch is provided at a side edge of the protection wall substantially along a standing direction of the protection wall. At least one catchable portion is provided at a side edge of the front end of the main portion substantially facing the side edge of the protection wall and is engageable with the catch.

The resilient contact is pressed by the male tab and is deformed resiliently towards the bottom wall as the male tab is inserted into the main portion. However, the catch of the protection wall is engageable with the catchable portion of the main portion. Thus, the main portion is kept substantially in a box shape and opening deformations of the main portion from bending edges can be prevented or reduced.

The catch preferably projects sideways from each of the substantially opposite side edges of the leading end of the protection wall with respect to the standing direction. The catchable portion preferably is formed by cutting off or recessing each of the substantially opposite side edges of the front end of the main portion so as to be engageable with the corresponding catch by receiving the catch from the front. Thus, the catches engage the catchable portions at positions as close as possible to the bending edges, which are supporting points of opening movements of the main portion. Thus, the catches securely prevent the opening deformations of the main portion from the bending edges. Further, the locking construction realized by the catches and the catchable portions can be formed as the protection wall is formed, and formation efficiency is better due to easy assembling.

The resilient contact preferably extends obliquely forward from a base end thereof at the bottom wall in the main portion. The resilient contact is folded towards the bottom wall to form a leg to be held substantially in contact with the bottom wall, after a contact portion to be held in contact with the male tab is formed.

The male tab contacts the contact portion and presses the resilient contact towards the bottom wall. However, the catches are engaged with the catchable portions at a position near a point of action of force accompanying the insertion of the male tab. Thus, a better effect of keeping the main portion in box shape can be expected.

A base end of the protection wall with respect to the standing direction is at a position slightly receded from the front edge of the main portion, preferably by a distance corresponding to the thickness of the protection wall.

Engaging holes are formed in side walls of the main portion. Engaging pieces are formed on the resilient contact and are loosely fittable in the engaging holes to prevent an excessive deformation of the resilient contact.

The protection wall stands in the standing direction at least substantially to a height corresponding to a folded portion of the contact.

Front edges of substantially opposite side walls and/or of a ceiling wall are beveled or rounded to form guiding surfaces for guiding the insertion of the male tab into the female terminal fitting and/or for guiding the insertion of the female terminal fitting into a connector housing.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 3:
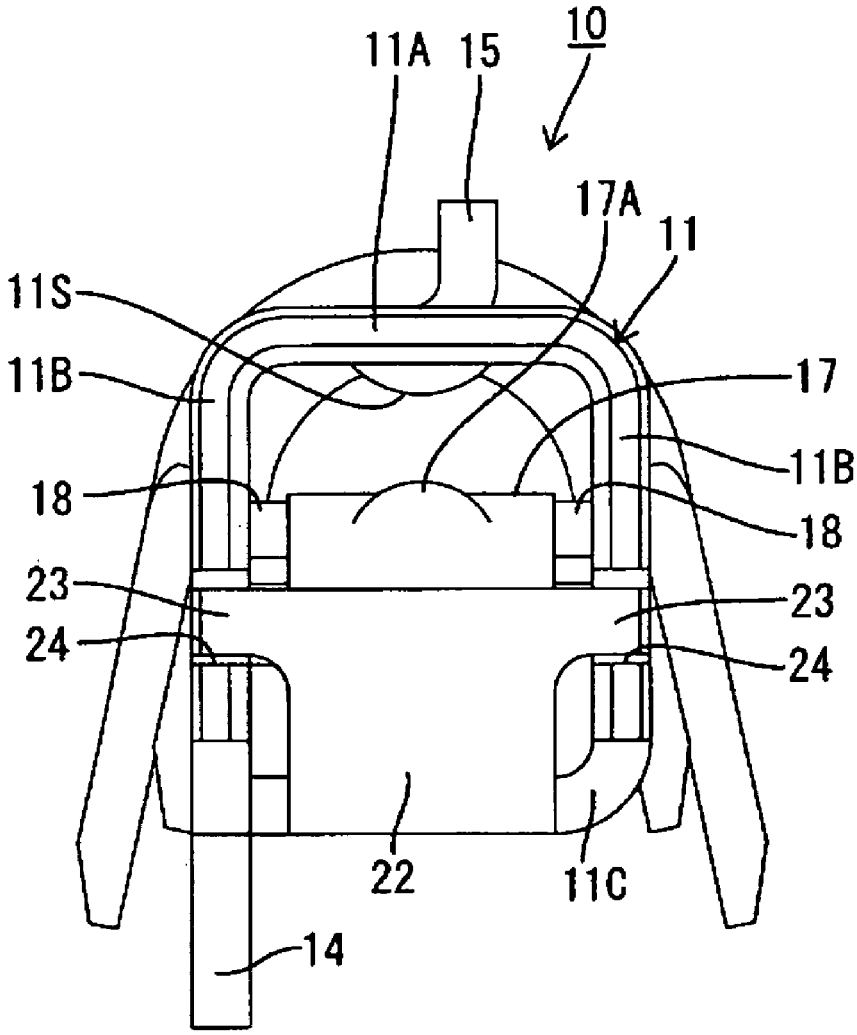
FIG. 3 is a front view of the female terminal fitting.
Figure 4:
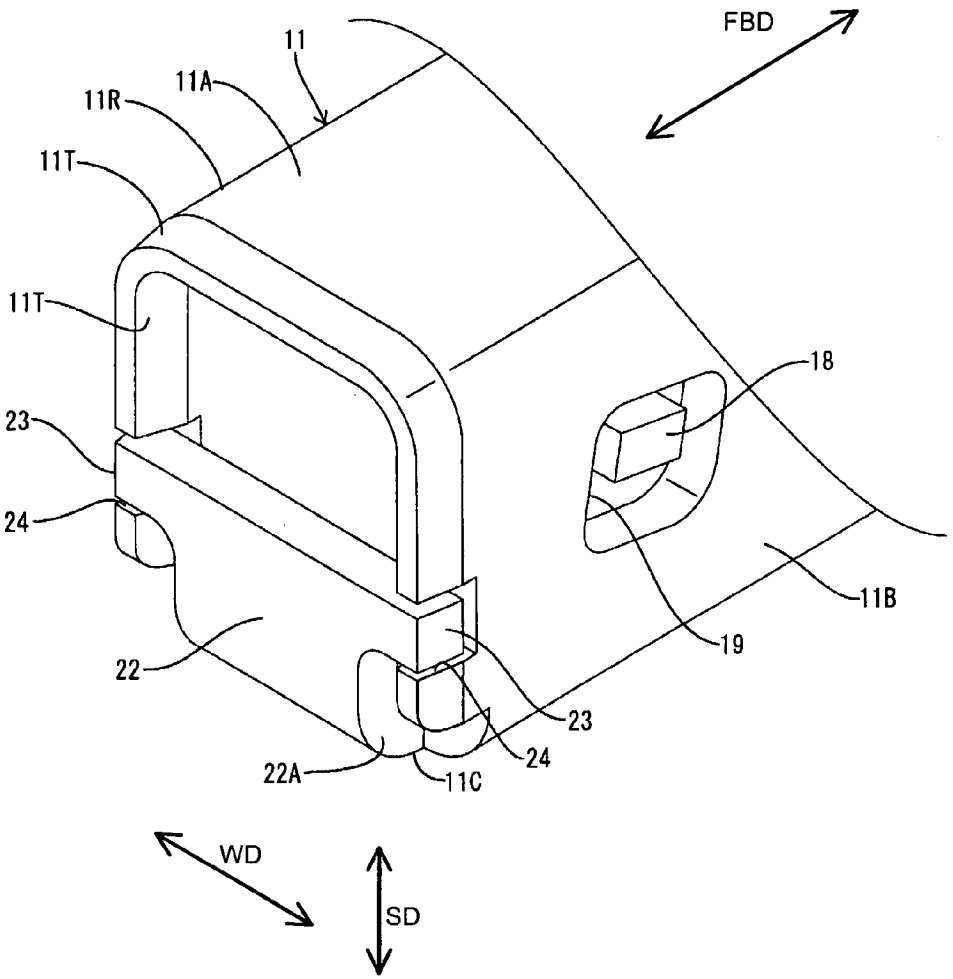
FIG. 4 is an enlarged perspective view showing an essential portion of the female terminal fitting.
Figure 5:
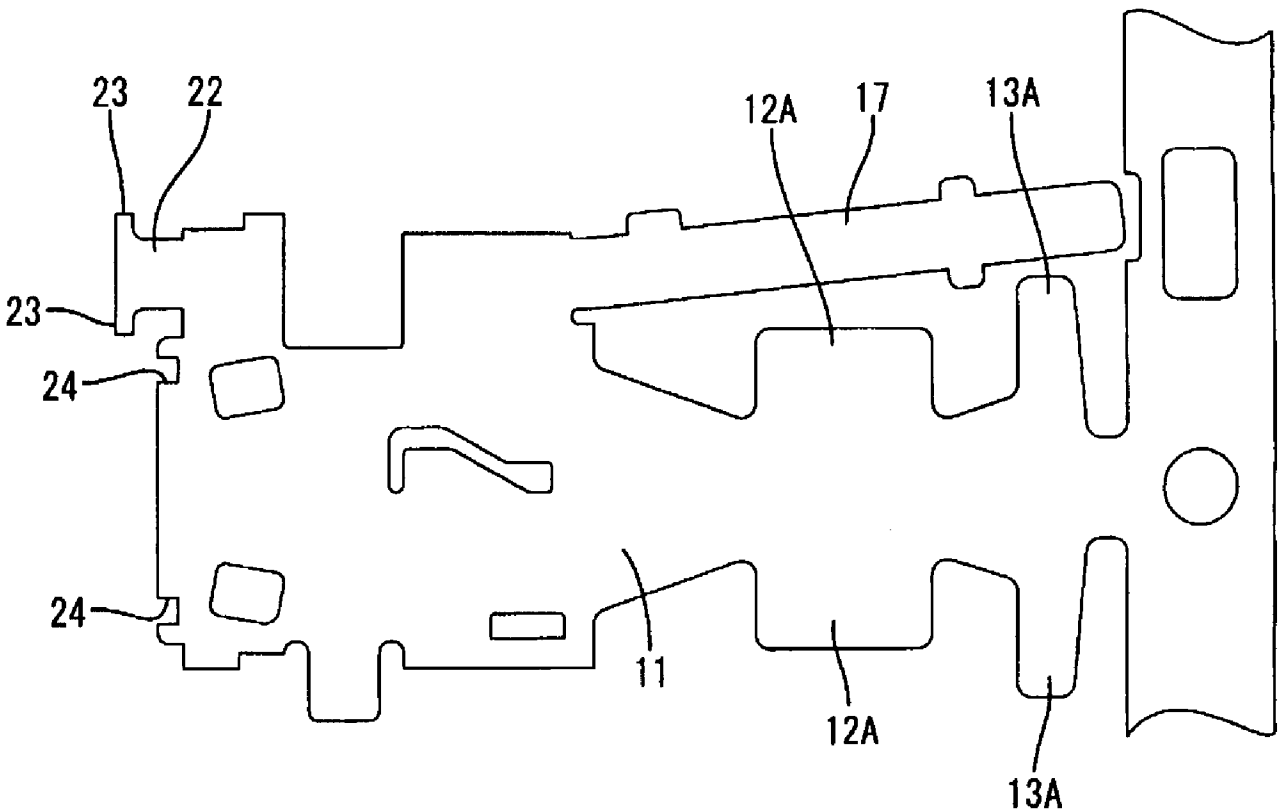
FIG. 5 is a development of the female terminal fitting.
Figure 6:
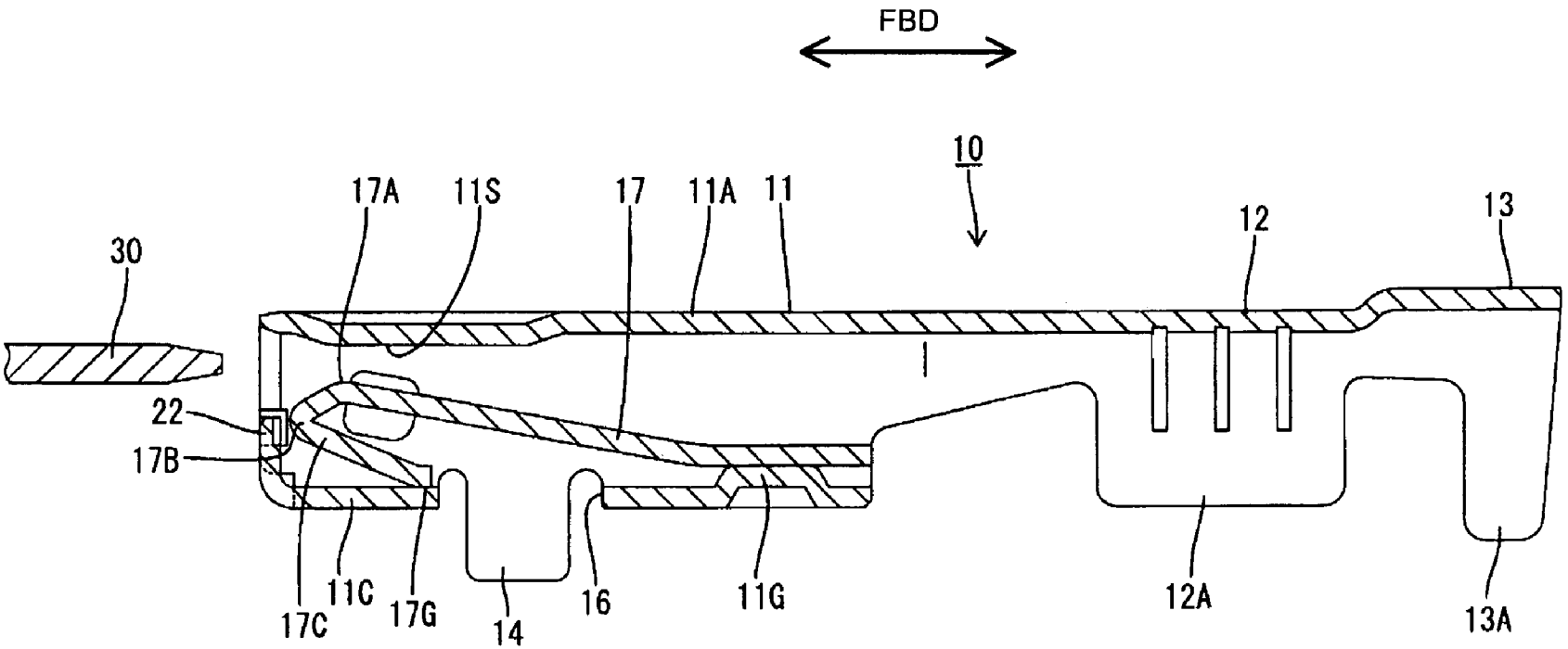
FIG. 6 is a section showing a state before a male tab is inserted.

A female terminal fitting according to the invention is identified by the numeral 10 in FIGS. 1 to 7. The female terminal fitting 10 is formed by stamping or cutting an electrically conductive metallic plate, as shown in FIG. 5, and then bending, folding and/or embossing the plate. The finished female terminal fitting 10 is narrow and long along forward and backward directions FBD. In this regard, the forward and backward directions FBD refers to inserting and withdrawing directions of the female terminal fitting 10.

The female terminal fitting 10 is of unitary construction and has opposite front and rear ends. A main portion 11 is formed at the front end and is configured to receive a male tab of a mating male terminal fitting. A wire barrel portion 12 is formed behind the main portion 11 and is configured to be crimped, folded or bent into connection with an end of a core of an unillustrated insulated wire. An insulation barrel 13 is behind the wire barrel 12 at the rear end of the female terminal fitting 10 and is configured to be crimped, folded or bent into connection with an end of an insulation coating. The wire barrel 12 has two crimping pieces 12A on opposite sides of the longitudinal center of the female terminal fitting 10. Similarly, the insulation barrel portion 13 has two crimping pieces 13A on opposite of the longitudinal center of the female terminal fitting 10 (see FIG. 5).

As shown in FIG. 3, the main portion 11 defines a substantially box shape with open front and rear ends. More particularly, the main portion 11 has a ceiling wall 11A, first and second sidewalls 11B bent at substantially right angles from opposite sides of the ceiling wall 11A and a bottom wall 11C bent at a right angle from the right sidewall 11B. The terms bottom and ceiling are used herein to provide a convenient frame of reference, but are not intended to imply a required gravitational orientation.

A stabilizer 14 projects down beyond the bottom wall 11C from the free end of the left sidewall 11B. The stabilizer 14 can be received in a guiding groove formed in a cavity of an unillustrated connector housing. Thus, the female terminal fitting 10 can be inserted into the cavity in only one rotational orientation and is stabilized during insertion. A cut is made along forward and backward directions FBD in an intermediate portion of the ceiling wall 11A and this cut portion is bent up to form a projection 15 that is substantially trapezoidal in side view. The projection 15 functions similar to the stabilizer 14 by stabilizing the posture of the female terminal fitting 10 and preventing an erroneous mounting of the female terminal fitting 10.

A locking hole 16 is formed in the bottom wall 11C of the main portion 11 (see FIG. 6), and the stabilizer 14 projects from an edge of this locking hole 16. A resilient lock in the cavity of the female connector housing is insertable into the locking hole 16 to lock the female terminal fitting 10 in the cavity.

A resiliently deformable resilient contact piece 17 extends from the rear end of the bottom wall 11C and is bent back in the main portion 11. More specifically, the resilient contact piece 17 has a tongue-shaped portion that extends obliquely forward from a base 11G that is raised near the rear end of the bottom wall 11C. A contact 17A is formed near the front end of the resilient contact piece 17, and can be held in contact with a male tab 30 of a mating male terminal fitting. A fold 17B is formed on the resilient contact piece 17 forward of the contact 17A, and a leg 17C extends obliquely down and back from the fold 17B. A touching portion 17G is formed at the free end of the leg 17C and contact the bottom wall 11C, for applying a spring force of the resilient contact piece 17.

The contact 17A of the resilient contact piece 17 is embossed or bent to define a convex surface projecting towards the ceiling wall 11A. The contact 17A cooperates with a touching protrusion 11S that bulges down from the ceiling wall 11A to define an insertion path for the male tab 30. A spacing between the contact 17A of the resilient contact piece 17 and the touching protrusion 11S of the ceiling wall 11A in a natural state is slightly less than the thickness of the male tab 30. Accordingly, the male tab 30 can be held tightly between the contact 17A and the touching protrusion 11S with the resilient contact piece resiliently deformed towards the bottom wall 11C. Thus, the male and female terminal fittings are connected electrically.

Figure 1:
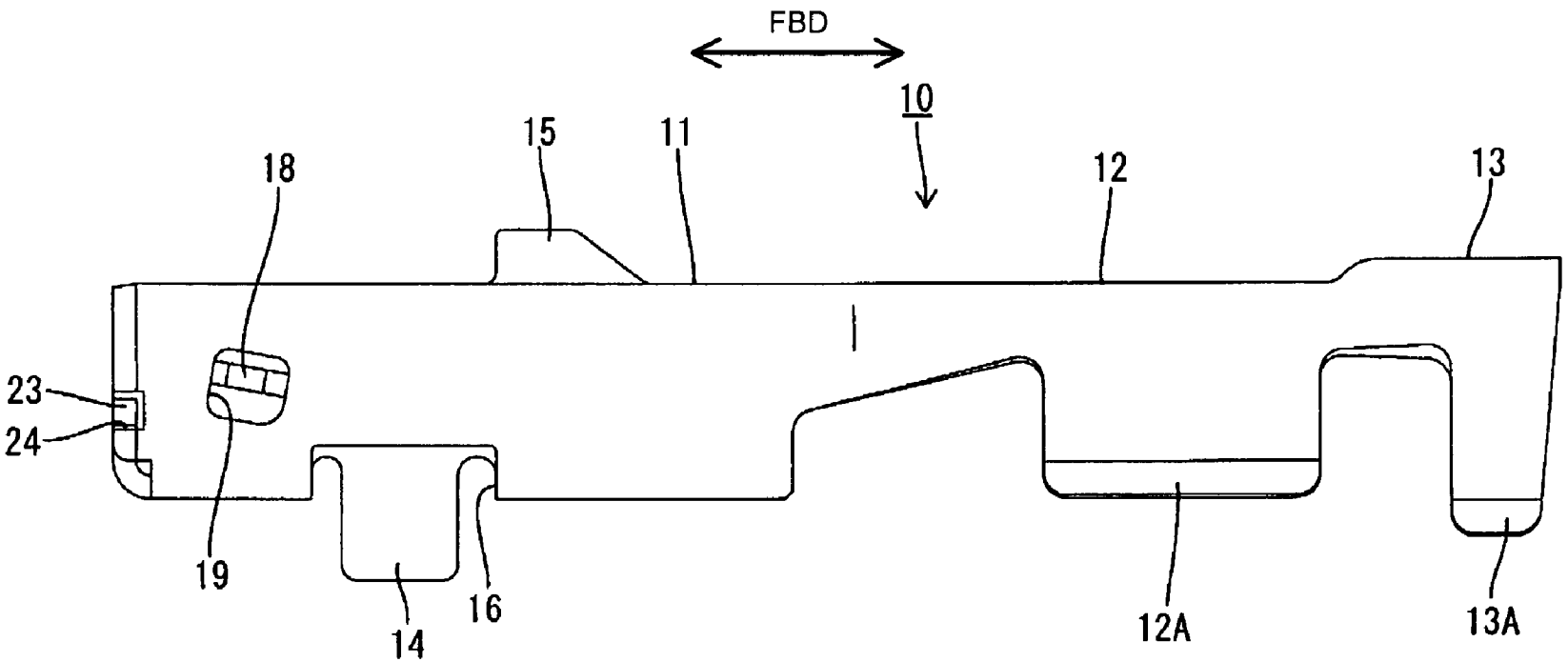
FIG. 1 is a right side view of a female terminal fitting according to one embodiment of the invention.
Figure 2:
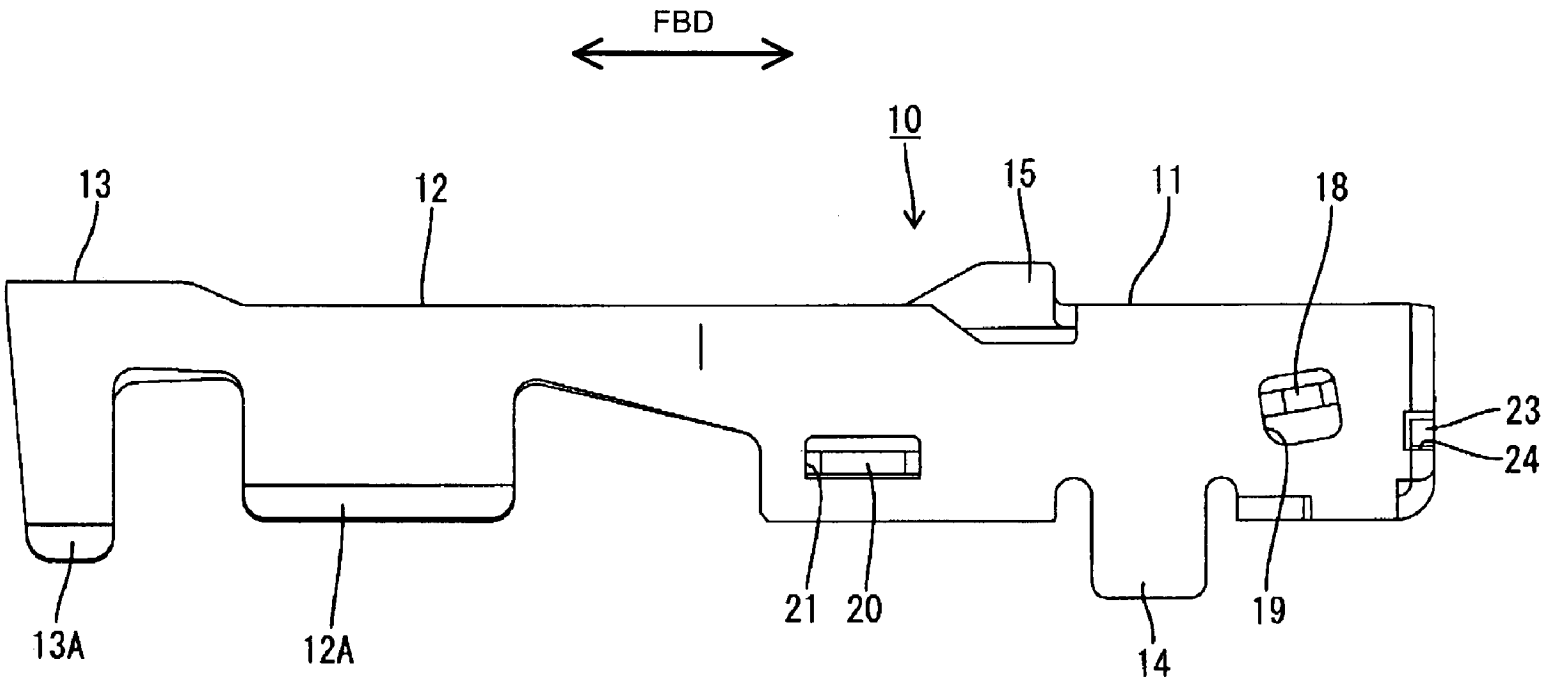
FIG. 2 is a left side view of the female terminal fitting.

Two engaging pieces 18 project out at opposite side edges of the resilient contact piece 17 and extend along a widthwise direction WD substantially normal to the forward and backward directions FBD, as shown in FIGS. 2 to 4. The engaging pieces 18 are substantially at the same height as the contact 17A. Engaging holes 19 are formed in the opposite side walls 11B of the main portion 11 at positions corresponding to the engaging pieces 18. The engaging pieces 18 are loosely fittable into the corresponding engaging holes 19 to prevent excessive deformation of the resilient contact piece 17. A locking piece 20 projects sideways in the widthwise direction WD at a side edge of the resilient contact piece 17 near the base 11G, as shown in FIG. 2. A locking hole 21 is formed in the sidewall 11B of the main portion 11 at a position corresponding to the locking piece 20 and receives the locking piece 20 to prevent the resilient contact piece 17 from being lifted from the base 11G.

A protection wall 22 is provided before the resilient contact piece 17 and forms part of the front surface of the main portion 11. As shown in FIG. 4, the protection wall 22 is bent at the front edge of the bottom wall 11C to stand up at a right angle toward the ceiling wall 11A, and closes a lower portion of an opening in the front surface of the main portion 11 while leaving a clearance to insert the male tab 30 between the leading edge of the protection wall 22 with respect to its standing direction SD and the ceiling wall 11A. In this way, the protection wall 22 interferes with external matter that could enter through the front opening of the main portion 11. Thus, the resilient contact piece 17 in the main portion 11 is protected and keeps its specified spring performance.

Rectangular catches 23 out along a widthwise direction WD from opposite sides of the leading end of the protection wall 22 with respect to the standing direction SD. Catch receiving portions 24 are provided at opposite side edges of the front end of the main portion 11 and face the catches 23. The catch receiving portions 24 are formed by cutting off the parts of the opposite side edges of the front end of the main portion 11 corresponding to the catches 23 and are substantially U-shaped for receiving and engaging the catches 23.

The protection wall 22 is bent from bottom wall 11C at a bend line 22A that is receded slightly from the front edge of the main portion 11 by a distance corresponding to the thickness of the protection wall 22, and the bottom ends of the facing side walls 11B are cut off to facilitate the bending operation. Thus, the protection wall 22 is substantially L- or T-shaped when viewed from the front (see FIG. 3), and stands up substantially vertically in the standing direction SD and has the front end thereof substantially aligned with the front edge of the main portion 11 when viewed sideways (see FIG. 2). The front edges of the opposite side walls 11B and the ceiling wall 11A are beveled at inner and outer surfaces, as shown in FIG. 4, to form more guiding surfaces 11T. The inner guiding surface 11T guides the insertion of the male tab 30, whereas the outer guiding surface 11T guides the insertion of the female terminal fitting 10 into the cavity.

The unillustrated female housing can fit into a receptacle of an unillustrated male housing. Thus, the male tab 30 of the male terminal fitting in the male housing is inserted from the front into the main portion 11 of the female terminal fitting 10 in the female housing.

Figure 7:
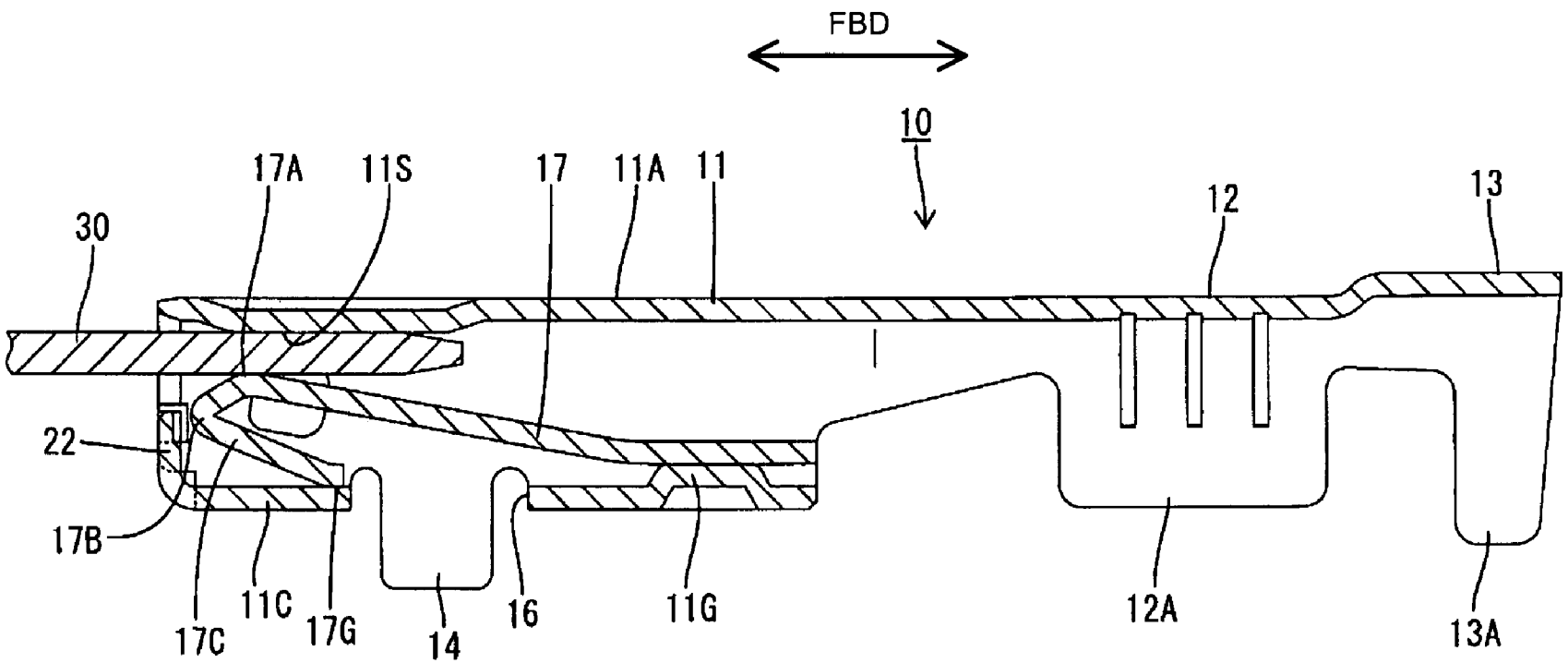
FIG. 7 is a section showing a state after the male tab is inserted.
Figure 8:
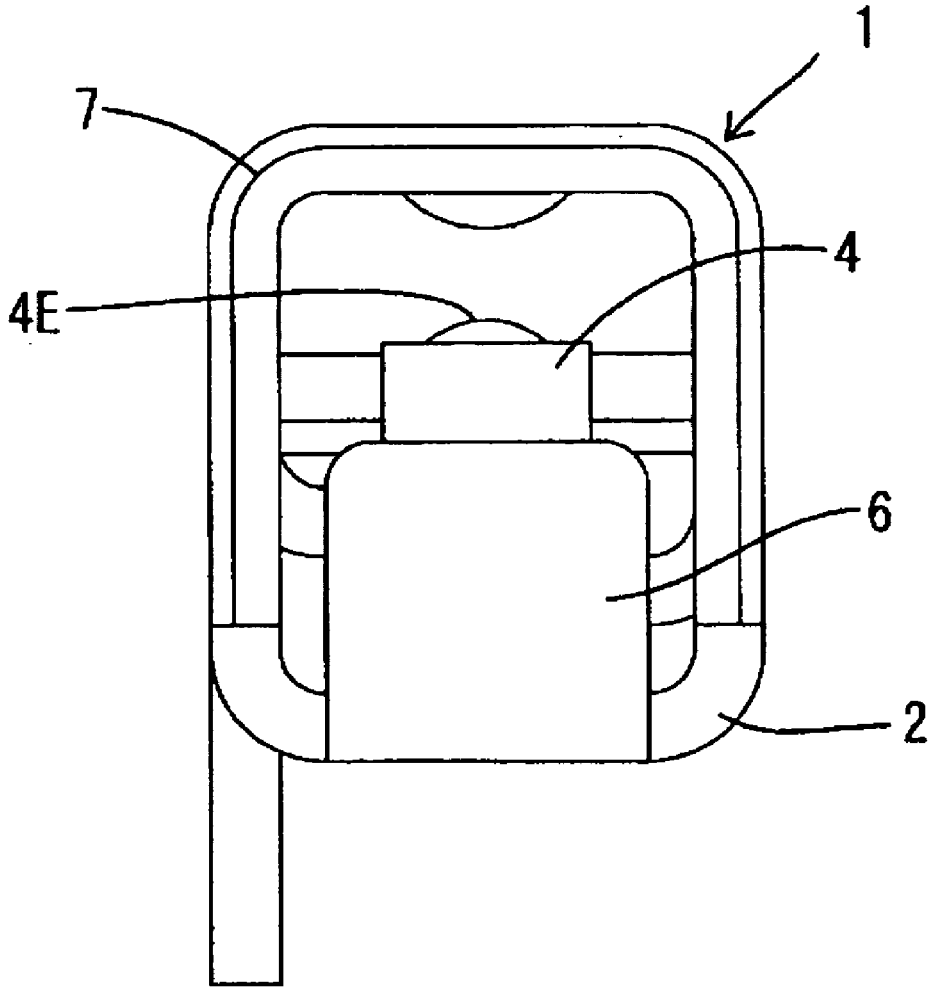
FIG. 8 is a front view of a prior art female terminal fitting.
Figure 9:
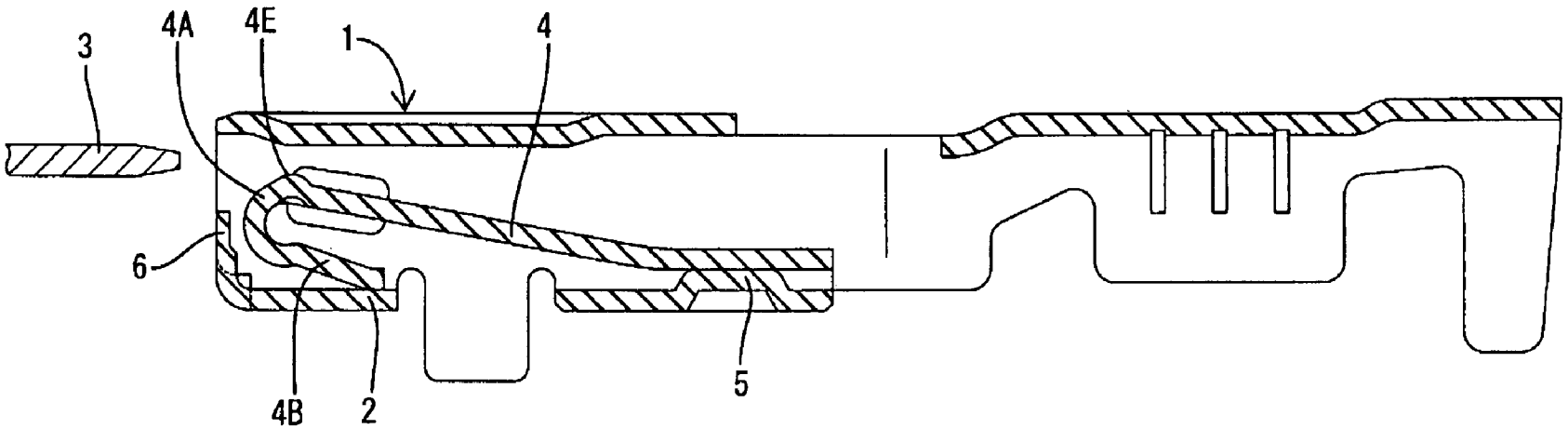
FIG. 9 is a view of the prior art female terminal fitting corresponding to FIG. 6.

The male tab 30 can be pushed between the contact portion 17A and the touching protrusion 11S as shown in FIG. 7. As a result, the resilient contact piece 17 is pressed down towards the bottom wall 11C and deforms resiliently with the base portion 11G and the touching portion 17G as supports. At this time, the fold 17B of the resilient contact piece 17 resiliently deforms and reduces a radius of curvature. Thus, a resiliently restoring force is generated and translates into a force that displaces the leg 17C down from the fold 17B. The touching portion 17G contacts the bottom wall 11C, and thus displacements along forward and backward directions FBD are prevented, and the leg 17C lets the bottom wall 11C receive an excessive force. On the other hand, a force to lift the resilient contact piece 17 as the fold 17B is deformed resiliently acts at the leg 17C, and there is a possibility of losing a balance of force to keep the entire main portion 11 in box shape. Thus, the free-ends of the opposite side walls 11B of the main portion 11 may displace in an opening direction with bending edges 11R (see FIG. 4) of the ceiling wall 11A as base ends. However, the catches 24 of the main portion 11 engage with the catching portions 23 of the protection wall 22. Thus, the opening movements of the free-end sides from the bending edges 11R of the main portion 11.

In this way, the catches 23 of the protection wall 22 engage the catch receiving portions 24 of the main portion 11 to enable the main portion 11 to be kept in box shape. Thus, opening deformations of the main portion 11 at the bending edges 11R is prevented. Further, the engagement of the catches 23 with the catch receiving portions 24 prevents deformation of protection wall 22 and protects the resilient contact piece 17 more securely.

The catches 23 project sideways from the opposite side edges of the leading end of the protection wall 22 with respect to the standing direction SD and engage the catch receiving portions 24 at heights as close as possible to the bending edges 11R, which are supports of the opening movements in the main portion 11. Thus, opening deformations of the main portion 11 from the bending edges 11R are prevented more securely. The catch receiving portions 24 are formed by cutting off the side edges of the front end of the main portion 11 and receive the catches 23. Thus, a locking construction realized by the catches 23 and the catch receiving portions 24 can be formed as the protection wall 22 is formed, and operability is better due to easy assembling.

Furthermore, the male tab 30 contacts the contact portion 17A to press the resilient contact piece 17 down toward the bottom wall 11C. Thus, the catches 23 engage the catch receiving portions 24 at positions close to a point of action of force accompanying the insertion of the male tab 30. Thus, a better effect of keeping the main portion 11 in box shape can be expected.

The invention is not limited to the above described and illustrated embodiment. For example, the following embodiment is also embraced by the technical scope of the present invention as defined by the claims. Beside the following embodiment, various changes can be made without departing from the scope and spirit of the present invention as defined by the claims.

The catches project out along the widthwise direction from opposite side edges of the protection wall 22 in the foregoing embodiment. However, bulges may project out along the widthwise direction WD from opposite side edges of the protection wall. Pressing portions may project from the leading ends of the bulges in a direction along the opposite side walls of the main portion. Additionally, the catches may having a substantially L-shape in plan view and may be formed by the bulges or the pressing portions. Opening deformations of the main portion can be prevented more securely since the opening movements of the opposite side walls of the main portion are suppressed more securely by the pressing portions.

Two catches are provided at the opposite side edges of the protection walls in the foregoing embodiment. However, one catch may be provided at one of these opposite side edges according to the invention. Even in such a case, the opening deformations of the main portion can be prevented if the engaging action of the catch and the catchable receiving portion is displayed.

The catches project toward the catchable portions from the side edges of the protection wall and the catchable portions are formed by cutting off the side edges of the front end of the main portion in the foregoing embodiment. Conversely, the catches may be formed by cutting off the side edges of the protection wall and the catchable portions may be provided to project toward the catches from the side edges of the front end of the main portion according the invention.

Although the catches are provided at the leading end of the protection wall with respect to the standing direction SD in the foregoing embodiment, they may be provided at intermediate positions of the protection wall with respect to the standing direction SD according to the invention.

What is claimed is:

1. A female terminal fitting comprising:

a substantially box-shaped main portion having an open front end and an opposite rear end, a ceiling wall, a bottom wall and opposite side walls extending substantially along forward and backward directions, a resilient contact piece projecting from the bottom wall of the main portion and being resiliently deformable towards the bottom wall, a protection wall projecting substantially orthogonally from bottom wall towards the ceiling wall at the front end of the main portion and disposed before the resilient contact piece, the protection wall having a free top edge defining a portion of the protection wall farthest from the bottom wall, at least one catch at a side edge of the protection wall, the catch having a free top edge extending substantially collinearly from the free top edge of the protection wall, and at least one catch receiving portion on at least one of the side walls at the front end of the main portion substantially facing the side edge of the protection wall and engaging the catch.

2. The female terminal fitting of claim 1, wherein the resilient contact piece has a base end at the wall and extends obliquely forward from the base end and away from the wall, a front portion of the resilient contact piece being folded to form a leg in contact with the wall.

3. The female terminal fitting of claim 1, wherein a base end of the protection wall is slightly receded from a front edge of the main portion by a distance corresponding to the thickness of the protection wall.

4. The female terminal fitting of claim 1, wherein engaging holes are formed in sidewalls of the main portion, engaging pieces projecting from the resilient contact piece and fit loosely in the engaging holes to prevent excessive deformation of the resilient contact piece.

5. The female terminal fitting of claim 1, wherein the protection wall stands in a standing direction at least to a height of a fold of the contact piece.

6. The female terminal fitting of claim 1, wherein inner and outer surfaces at front edges of opposite side walls and a ceiling wall of the main portion define beveled guiding surfaces for guiding the insertion of the male tab into the female terminal fitting and for guiding the insertion of the female terminal fitting into a connector housing.

7. The female terminal fitting of claim 1, wherein the at least one catch comprises two catches projecting from opposite side edges of the protection wall, and the at least one catch receiving portion comprising catch receiving portions formed by cutting opposite side edges of the front end of the main portion for receiving the corresponding catches.

* * * * *